US006722177B1

(12) United States Patent
Walsh

(10) Patent No.: US 6,722,177 B1
(45) Date of Patent: Apr. 20, 2004

(54) SLIP-RESISTANT AQUATIC COMPONENT AND METHOD FOR MAKING THE SAME

(75) Inventor: Michael T. Walsh, Zionsville, IN (US)

(73) Assignee: Natare Corporation, Indianapolis, IN (US)

( * ) Notice: Subject to any disclaimer, the term of this patent is extended or adjusted under 35 U.S.C. 154(b) by 0 days.

(21) Appl. No.: 10/083,806

(22) Filed: Feb. 27, 2002

(51) Int. Cl.[7] ..... B21D 22/04
(52) U.S. Cl. ..... 72/379.2; 428/604
(58) Field of Search ..... 52/177, 179; 72/196, 72/327, 379.2; 280/169; 428/604

(56) References Cited

U.S. PATENT DOCUMENTS

| | | | | | |
|---|---|---|---|---|---|
| 1,091,214 | A | * | 3/1914 | Gruber | 52/177 |
| 1,771,405 | A | * | 7/1930 | Felsenthal | 52/179 |
| 3,217,845 | A | * | 11/1965 | Reynolds et al. | 428/604 |
| 4,044,186 | A | * | 8/1977 | Stangeland | 428/167 |
| 4,203,268 | A | | 5/1980 | Gladden, Jr. et al. | |
| 4,411,121 | A | | 10/1983 | Blacklin et al. | |
| 4,566,141 | A | | 1/1986 | Mahoney | |
| 4,737,060 | A | | 4/1988 | Birckhead | |
| 5,111,572 | A | | 5/1992 | Haiml et al. | |
| 5,399,406 | A | | 3/1995 | Matsuo et al. | |
| 5,673,585 | A | | 10/1997 | Bishop | |
| 5,702,799 | A | | 12/1997 | Brown et al. | |
| 5,735,155 | A | * | 4/1998 | Morton et al. | 72/379.2 |
| 5,904,011 | A | * | 5/1999 | Biro | 52/177 |

FOREIGN PATENT DOCUMENTS

| | | | | |
|---|---|---|---|---|
| GB | 2 062 735 | * | 6/1981 | 72/196 |

* cited by examiner

*Primary Examiner*—Lowell A. Larson
(74) *Attorney, Agent, or Firm*—Barnes & Thornburg

(57) ABSTRACT

A stainless steel aquatic component for use in an aquatic environment such as pools, spas, hot tubs, and shower rooms has a slip-resistant texture formed therein. The slip-resistant texture includes a plurality of protrusions which are punched into an outer surface of the aquatic component. A method of forming an aquatic component is also disclosed.

23 Claims, 3 Drawing Sheets

SLIP-RESISTANT AQUATIC COMPONENT AND METHOD FOR MAKING THE SAME

FIELD OF THE INVENTION

The present invention relates generally to an aquatic component, and more particularly to a slip-resistant aquatic component and method for making the same.

BACKGROUND OF THE DISCLOSURE

Aquatic components associated with, for example, swimming pools, spas, hot tubs, or showers are constructed from a variety of materials. For example, it is common for aquatic components to be constructed of plastic, metal, concrete, tile, or other materials.

It is desirable for an aquatic component to possess relatively high slip-resistant properties. However, some of the materials used in the construction of aquatic components do not possess high slip-resistant properties when provided in a particular surface finish. For example, plastic or metal that is finished with a smooth surface is slippery when wet.

As a result, a number of techniques have heretofore been utilized in an effort to increase the slip-resistant properties of aquatic components. For example, concrete components may be formed with a rough surface texture to enhance its slip-resistant properties. Adhesive strips constructed with a non-slip material have been secured to some aquatic components. Plastic aquatic components have been molded with a textured pattern in an effort to enhance slip-resistance. In regard to metallic aquatic components, a number of surface altering techniques have heretofore been utilized in an effort to enhance the slip-resistant properties thereof. For example, abrading techniques such as grinding or sand blasting have been used.

SUMMARY OF THE DISCLOSURE

According to illustrative embodiments of the present invention, an aquatic component and a method for forming the same are provided. The aquatic component includes a slip-resistant texture having a plurality of protrusions formed in a first surface thereof The method includes the step of contacting a surface of the aquatic component to form protrusions in the opposite surface so as to create the slip-resistant texture.

One illustrative embodiment of the present invention provides a method of forming a slip-resistant texture on an aquatic component. The aquatic component has a first surface and a second, opposite surface. The method includes the steps of positioning the aquatic component in a work machine and contacting the second surface with a work tool to form protrusions in the first surface.

Another illustrative embodiment of the present invention provides a slip-resistant article including an aquatic component having first and second opposite surfaces. The aquatic component is prepared by a process including the steps of positioning the aquatic component in a work machine and contacting the second surface with a work tool to form protrusions in the first surface.

In yet another illustrative embodiment of the present invention, an aquatic component is provided which includes a metal body having first and second opposite surfaces. The first surface has a plurality of protrusions that form a slip-resistant texture. The second surface has a plurality of indentations defined therein, each of which corresponds with one of the plurality of protrusions.

Exemplary implementations of these concepts include drain covers, gutters, and pool steps along with the associated methods for making the same. Such implementations are suitable for use in environments such as pools, saunas, hot tubs, spas, bathing facilities, and the like.

Additional features of the present invention will become apparent to those killed in the art upon consideration of the following detailed description of illustrative embodiments exemplifying the best mode of carrying out the invention as presently perceived.

BRIEF DESCRIPTION OF THE DRAWINGS

The detailed description particularly refers to the accompanying figures in which.

DETAILED DESCRIPTION OF ILLUSTRATIVE EMBODIMENTS

Figure 1:
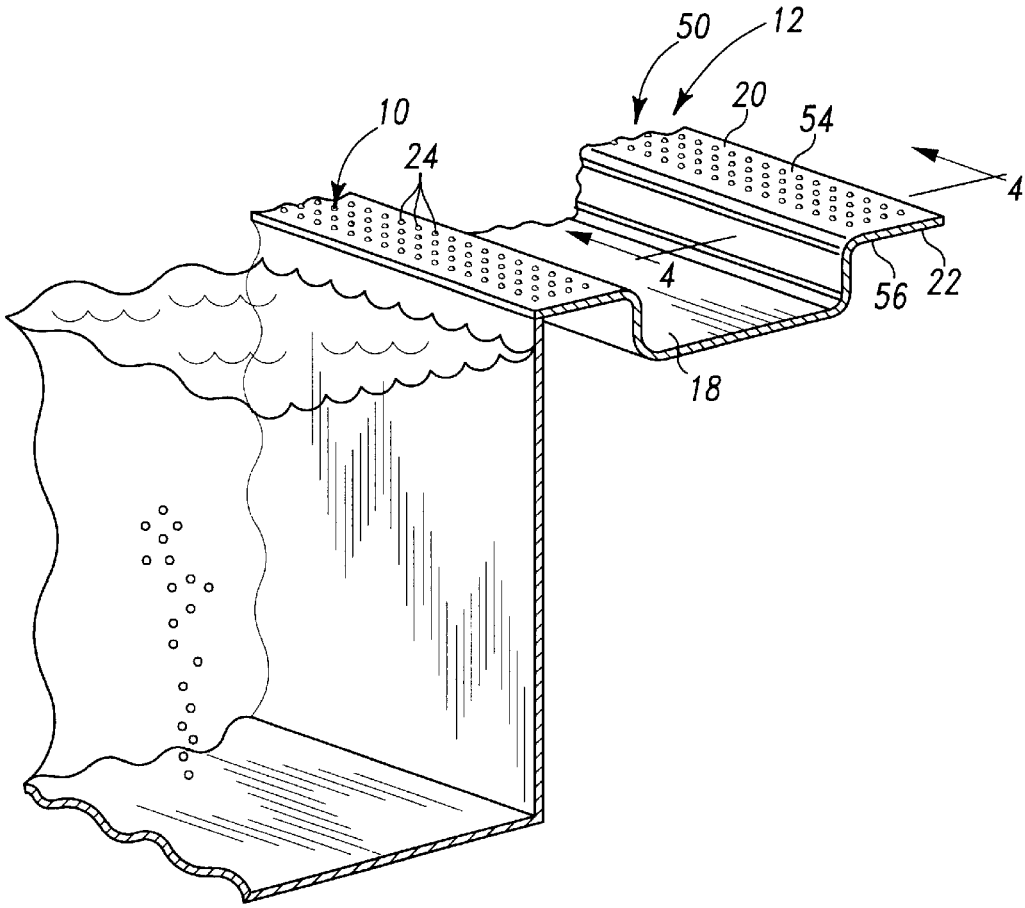
FIG. 1 is a fragmentary perspective view of a pool gutter having a slip resistant surface defined therein.

While the invention is susceptible to various modifications and alternative forms, specific embodiments thereof have been shown by way of example in the drawings and will herein be described in detail. It should be understood, however, that there is no intent to limit the invention to the particular forms disclosed, but on the contrary, the intention is to cover all modifications, equivalents, and alternatives falling within the spirit and scope of the invention as defined by the appended claims.

Figure 2:
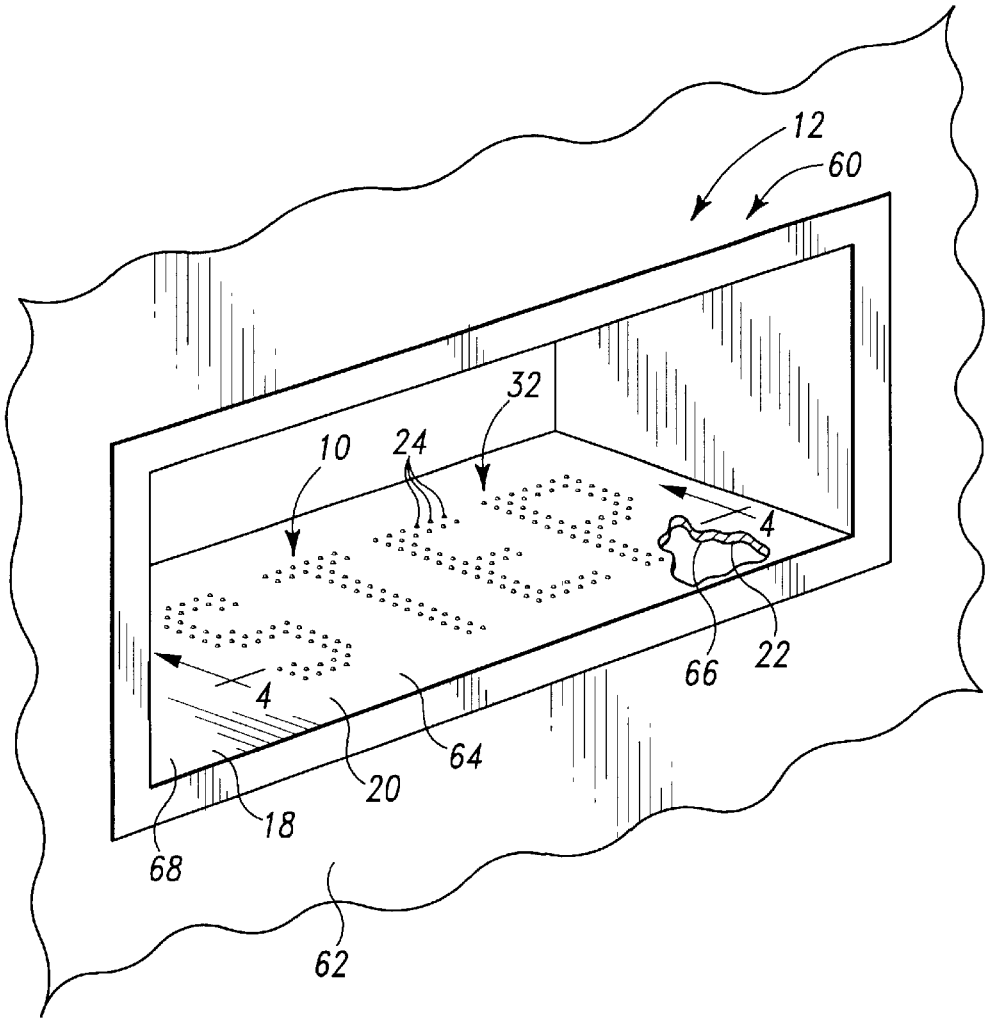
FIG. 2 is a fragmentary perspective view of a pool step having a slip resistant surface defined therein.
Figure 3:
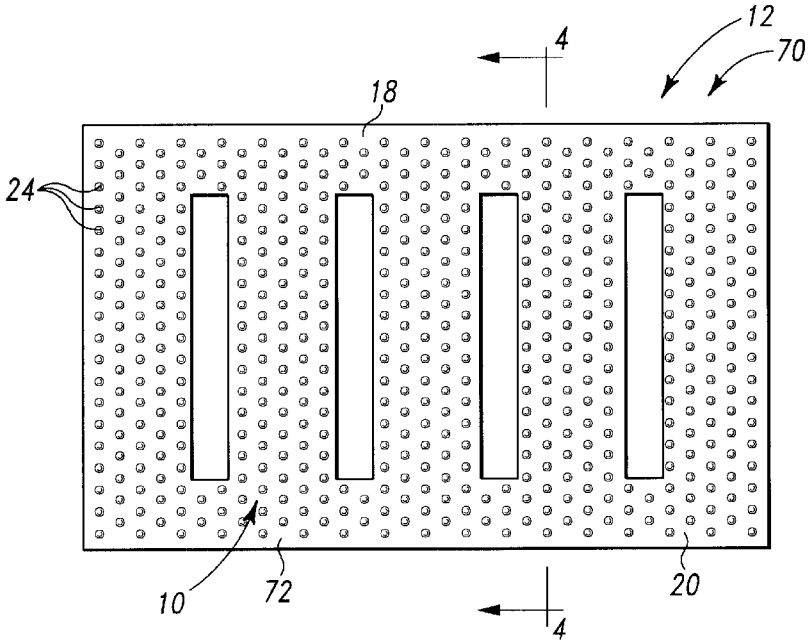
FIG. 3 is a plan view of a drain cover having a slip resistant surface defined therein.

Referring now to FIGS. 1–3, there is shown a number of aquatic components 12 having a slip-resistant texture 10 defined therein. What is meant herein by the term "aquatic component" is any component, structure, or device that is utilized in the construction or equipping of areas, rooms, structures, assemblies, or mechanisms which are exposed to water or other liquids. For example, aquatic components may include components utilized in the construction of swimming pools or the area surrounding such pools. Aquatic components may also include the components utilized in the construction of a spa, hot tub, or shower room. Specific examples of aquatic components include pool gutters, pool steps, drain covers, skimmer covers, hand rails, and the like. Other specific examples of aquatic components include structures utilized in the construction of an aqueous environment in the form of horizontal surface structures such as pool edges or surrounds, along with floors for use in or around pools, hot tubs, or the like. In addition to such horizontal surfaces, aquatic components may also take the form of substantially vertical structures such as end walls for competitive swimming turns. Aquatic components may also take the form of seating surfaces such as life guard seats, swimming instructor seats, or the like, or stairs, or other inclined surfaces such as accessory ramps or inclines associated with therapeutic pools, tubs, or the like. Aquatic components may also be provided as pool structures utilized as markings such as pool signs, racing stripes, or the like. It should be appreciated that above-described examples of aquatic components are exemplary in nature, and that numerous other components, structures, or devices for use in aquatic environments such as pools, spas, hot tubs, or shower rooms may also be constructed with the teachings described herein.

As shown in FIGS. 1–3, each of the aquatic components 12 includes a component body 18 having first or outer surface 20 and an opposite second, or inner surface 22. The outer surface 20 is generally the surface of the aquatic component 12 that is contacted by user. For example, in the case of a drain cover or step, the outer surface 20 is the surface of the component 12 on which the user steps (i.e., walks). As such, the outer surface 20 has the slip-resistant texture 10 defined therein.

The aquatic components 12 may be constructed from any type of material which may be permanently deformed under pressure as a result of being punched or otherwise formed as described below. In a specific exemplary embodiment, the aquatic components 12 are constructed from metal. In a specific implementation of this exemplary embodiment, the aquatic components 12 are constructed from stainless steel such as 12-gauge stainless steel (0.105" thick). Stainless steel has a number of favorable characteristics such as corrosion resistance which render it desirable for use in aquatic environments. Moreover, certain plastics also may be utilized in the construction of the aquatic components 12 described herein.

As will be described below in greater detail, the slip-resistant texture 10 utilized in the construction of the aquatic components 12 is provided by the use of a number protrusions 24 which extend outwardly from the flat portions of the outer surface 20 of the aquatic component 12. The protrusions 24 may be formed in the body 18 of the component 12 by the use of any one of a number of manufacturing techniques. One manufacturing technique which is particularly useful for forming the protrusions 24 in metallic aquatic components 12 is punching.

Figure 4:
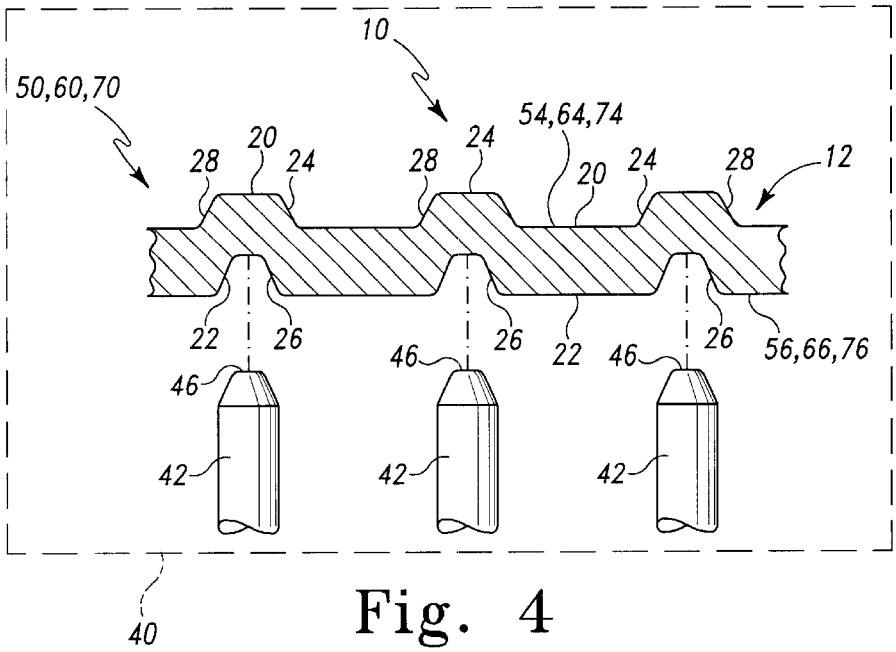
FIG. 4 is a diagrammatic fragmentary sectional view taken along line 4—4 of FIGS. 1–3, showing a portion of an aquatic component positioned in a work machine for forming the protrusions.

As shown in greater detail in FIG. 4, an upwardly extending side portion 28 of each of the protrusions 24 extends outwardly from the flat portions of the outer surface 20. A number of indentations 26 are formed in the lower surface 22 of the component body 18. By virtue of the forming process (e.g., punching), each of the indentations 26 corresponds in location with each of the protrusions 24. The protrusions 24 may be spaced apart from one another by any distance which provides a desired slip-resistant texture. In an exemplary embodiment, the protrusions 24 (as measured center to center) may be spaced apart from one another by a distance of five (5) millimeters.

Moreover, the protrusions 24 may be arranged in any orientation relative to one another. For example, as shown in FIGS. 1 and 3, the protrusions 24 may be arranged relative to one another in a substantially linear orientation. Alternatively, as shown in FIG. 2, the protrusions 24 of the slip-resistant texture 10 may be arranged in a decorative pattern 32. Such a decorative pattern 32 may take on numerous forms. For example, the decorative pattern 32 may take on the form of a text message 34 such as the instructional text message "STEP" created by the pattern of the protrusions 24 of the slip-resistant texture 10. Alternatively, the decorative pattern 32 may be an aesthetic pattern which does not include a text message. The decorative pattern 32 may also take the form of a name or logo which is associated with the manufacturer of the aquatic component 12. It should also be appreciated that the protrusions 24 of the slip-resistant texture 10 may be arranged in a somewhat random orientation, if desired.

Specific exemplary embodiments of the aquatic components 12, with the slip-resistant texture 10 formed therein, are shown in FIGS. 1–3. In particular, as shown in FIG. 1, the aquatic component 12 may take the form of a pool gutter 50. The pool gutter 50 includes an upper gutter surface 54 and a lower gutter surface 56. The slip-resistant texture 10 is formed in the upper gutter surface 54. Specifically, the protrusions 24 of the slip-resistant texture 10 extend upwardly from the flat portions of the upper gutter surface 54. In such a manner, protection from slippage will be provided to a user A walking on, or otherwise contacting, the upper gutter surface 54 of the pool gutter 50.

In the exemplary embodiment illustrated in FIG. 2, the aquatic component 12 is embodied as a pool step 60 which is recessed into a wall 62 of a pool. The pool step 60 includes an upper step surface 64 and a lower step surface 66. The slip-resistant texture 10 is formed in the upper step surface 64. In particular, the protrusions 24 extend upwardly from the flat portions of the upper step surface 64. In such a manner, protection from slippage is provided to a user stepping on or otherwise positioning his foot on the pool step 60.

In another exemplary embodiment illustrated in FIG. 3, the aquatic component 12 is embodied as a drain cover 70. The drain cover 70 includes an upper cover surface 72 and a lower cover surface 76 (see FIG. 4). The slip-resistant texture 10 is formed in the upper cover surface 72. Specifically, the protrusions 24 of the slip-resistant texture 10 extend upwardly from the flat portions of the upper cover surface 72. As such, a user walking on, or otherwise contacting, the drain cover 70 is afforded protection from slippage by the slip-resistant texture 10.

Referring now to FIG. 4, there is shown a diagrammatic illustration of a work machine 40 which may be utilized to fabricate the aquatic components 12 described herein. In the exemplary embodiment described herein, the work machine 40 is embodied as a punch press machine. As such, the punch press 40 includes a number of work tools such as punches 42. The punches 42 may be operated to form the protrusions 24 in the aquatic components 12. Specifically, when a portion of the component body 18 of the aquatic component 12 is positioned in the punch press 40, the press is operated such that the tips 46 of the punches 42 impact or otherwise contact the inner surface 22 of the component body 18. The impact of the punches 42 against the inner surface 22 causes the formation of the indentations 26, along with the formation of the corresponding protrusions 24 formed in the outer surface 20 of the component body 18.

In regard to the specific exemplary embodiments of FIGS. 1–3, the punch press 40 may be operated to form the slip-resistant texture 10 utilized in the design of the pool gutter 50 (see FIG. 1), the pool step 60 (see FIG. 2), or the drain cover 70 (see FIG. 3). For example, a portion of the pool gutter 50 may be machined with the punch press 40 such that the punches 42 are operated to punch the lower gutter surface 56 thereby forming the protrusions 24 in the upper gutter surface 54. Similarly, a portion of the pool step 60 may also be machined with the punch press 40 such that the punches 42 are operated to punch the lower step surface 66 thereby forming the protrusions in the upper step surface 64. In a similar manner, a portion of the drain cover 70 may be machined by the punch press 40 such that the punches 42 are operated to punch lower cover surface 76 thereby forming the protrusions in the upper cover surface 72.

It should be appreciated that the portion of aquatic component 12 that is positioned in the punch press 40 may be the entirety of the aquatic component 12, or only a portion of the component 12. For example, the entire drain cover 70 may be positioned in the press 40 during formation of the protrusions 24. In such a manner, the drain cover 70 may otherwise be in final form prior to being punched in the punch press 40.

Alternatively, only a portion of the aquatic component 12 may be positioned in the press 40. For example, in the case of the pool step 60, only a plate 68 (see FIG. 2) may be positioned the press 40. In such a case, the plate 68 may be punched and then subsequently secured to the other plates which form the structure of the step 60. As such, it should be appreciated that the slip-resistant texture 10 may be punched into the aquatic component prior to final fabrication of the component. For example, the protrusions 24 may be punched into the metal body 18 of the pool gutter 50 prior to a bending or other forming operation which bends the body 18 of the pool gutter 50 into the generally U-shaped cross sectional shape shown in FIG. 1.

While the invention has been illustrated and described in detail in the drawings and foregoing description, such an illustration and description is to be considered as exemplary and not restrictive in character, it being understood that only the illustrative embodiments have been shown and described and that all changes and modifications that come within the spirit of the invention are desired to be protected.

There are a plurality of advantages of the present invention arising from the various features of the aquatic components described herein. It will be noted that alternative embodiments of each of the aquatic components of the present invention may not include all of the features described yet still benefit from at least some of the advantages of such features. Those of ordinary skill in the art may readily devise their own implementations of an aquatic component that incorporate one or more of the features of the present invention and fall within the spirit and scope of the present invention as defined by the appended claims.

For example, it should be appreciated that in addition to aquatic components, the concepts disclosed herein have many other useful applications. For example, the concepts described herein may be used in many medical, health, and food preparation applications. Indeed, the concepts disclosed herein may be used in any application in which stainless steel or other metals, fiberglass, or plastic are used in the construction of a structure which is in need of slip-resistant properties.

What is claimed is:

1. A method of forming a slip-resistant component, comprising the steps of:

positioning at least a portion of a stainless steel aquatic component in a work machine, said aquatic component having a first surface a second surface which is opposite said first surface;

contacting said second surface with a work tool so as to form a plurality of protrusions in said first surface.

2. The method of claim 1, wherein:

said contacting step includes the step of forming said plurality of protrusions in said stainless steel.

3. The method of claim 2, including:

shaping the aquatic component for use in a pool environment.

4. The method of claim 1, wherein said contacting step includes the step of forming said plurality of protrusions in a decorative pattern.

5. The method of claim 1, wherein said contacting step includes the step of punching said second surface with a punch so as to form said plurality of protrusions in said first surface.

6. The method of claim 1, wherein:

said aquatic component includes a gutter having an upper gutter surface and a lower gutter surface, and said contacting step includes the step of punching said lower gutter surface so as to form said plurality of protrusions in said upper gutter surface.

7. The method of claim 1, wherein:

said aquatic component includes a drain cover having an upper cover surface and a lower cover surface, and said contacting step includes the step of punching said lower cover surface so as to form said plurality of protrusions in said upper cover surface.

8. The method of claim 1, wherein:

said aquatic component includes a pool step for supporting a user, said pool step has an upper step surface and a lower step surface, and said contacting step includes the step of punching said lower step surface so as to form said plurality of protrusions in said upper step surface.

9. A slip-resistant article, comprising:

a stainless steel aquatic component having a first surface a second surface which is opposite said first surface, said aquatic component having (i) protrusions formed on said first surface by a work machine work tool, and (ii) indentations formed in said second surface with the work tool.

10. The article of claim 9, wherein said aquatic component is shaped for use in a Pool environment.

11. The article of claim 9, wherein said plurality of protrusions are arranged in a decorative pattern on said first surface.

12. The article of claim 9, wherein said process for preparing said aquatic component further comprises the step of punching said second surface with a punch so as to form said plurality of protrusions in said first surface.

13. The article of claim 9, wherein:

said aquatic component includes a gutter having an upper gutter surface and a lower gutter surface, and said process for preparing said aquatic component further comprises the step of punching said lower gutter surface so as to form said plurality of protrusions in said upper gutter surface.

14. The article of claim 9, wherein:

said aquatic component includes a drain cover having an upper cover surface and a lower cover surface, and said process for preparing said aquatic component further comprises the step of punching said lower cover surface so as to form said plurality of protrusions in said upper cover surface.

15. The article of claim 9, wherein:

said aquatic component includes a pool step for supporting a user, said pool step has an upper step surface and a lower step surface, and said process for preparing said aquatic component further comprises the step of punching said lower step surface so as to form said plurality of protrusions in said upper step surface.

16. An aquatic component, comprising:

a stainless steel body having a first surface and a second surface, wherein (i) said first surface has a plurality of protrusions defined therein which define a slip-resistant texture, (ii) said second surface has a plurality of indentations defined therein, (iii) each of said plurality of indentations corresponds with one of said plurality of protrusions.

17. The aquatic component of claim 16, wherein said body is shaped for use in a pool environment.

18. The aquatic component of claim 16, wherein said plurality of protrusions are arranged in a decorative pattern on said first surface.

19. The aquatic component of claim 16, wherein said plurality of protrusions and said plurality of indentations are punched into said body.

20. The aquatic component of claim 16, wherein said body is constructed of plastic.

21. A slip-resistant article for use in a pool environment, comprising:

a stainless steel aquatic component having a first surface and a second surface which is opposite said first surface, the component being shaped for use in a pool environment, a plurality of protrusions on said first surface, a plurality of indentations in said second surface at locations corresponding with the locations of the plurality of protrusions on said first surface.

22. The article of claim 21, wherein said component includes stainless steel of a thickness of about 12-gauge.

23. The article of claim 21, wherein said protrusions and indentations are formed by punching.

* * * * *

US006722177C1

(12) INTER PARTES REEXAMINATION CERTIFICATE (0267th)

United States Patent

Walsh

(10) Number: US 6,722,177 C1

(45) Certificate Issued: May 31, 2011

(54) SLIP-RESISTANT AQUATIC COMPONENT AND METHOD FOR MAKING THE SAME

(75) Inventor: Michael T. Walsh, Zionsville, IN (US)

(73) Assignee: Natare Corporation, Indianapolis, IN (US)

Reexamination Request:
No. 95/001,162, Apr. 30, 2009

Reexamination Certificate for:

| | |
|---|---|
| Patent No.: | **6,722,177** |
| Issued: | **Apr. 20, 2004** |
| Appl. No.: | **10/083,806** |
| Filed: | **Feb. 27, 2002** |

(51) Int. Cl.
*B21D 22/04* (2006.01)

(52) U.S. Cl. ..... 72/379.2; 428/604

(58) Field of Classification Search ..... 4/496, 4/507

See application file for complete search history.

(56) References Cited

U.S. PATENT DOCUMENTS 4,494,257 A * 1/1985 Peirish ..... 4/508
5,735,155 A 4/1998 Morton et al.

FOREIGN PATENT DOCUMENTS

EP 0 191 486 10/1990

OTHER PUBLICATIONS

Morton Manufacturing Company catalog, 1996, 40 pgs., Libertyville, IL.
"Textured Metal Pattern Chart" brochure, 1995, 6 pgs., Rigidized Metals Corporation, Buffalo, NY.
"Thick Turret Special Tooling," 1999 catalog, pp. 1–2, 18–19, 33, and back cover, Wilson Tool, White Bear Lake, MN.
Tool and Manufacturing Engineers Handbook, vol. 2, Forming, Wick et al., eds., 4th Ed., 1984, cover, verso, and pp. 4–7, 4–56, 4–57, 7–13, and 7–14, Society of Manufacturing Engineers (SME), Dearborn, MI.
"Manufacturers of the finest Swimming Pool Deck Equipment" brochure, published on or before at least Feb. 26, 2001, cover, back, and p. 30, Swan Manufacturing Corp., Canby OR.
"Stainless Steel Pool Products That Look Better and Last Longer" brochure, published on or before at least Feb. 26, 2001, 31 pgs., Frost Co.
"1992 Product Highlights, Swimming Pool, Aquatics & Recreational Equipment," 1992, 68 pgs., Recreonics Corporation, Indianapolis, IN.
"Halogen Almost Everything for the Pool," 1994 Catalog No. 69, 61 pgs., Halogen Supply Co., Inc., Chicago, IL.
"Brock Enterprises, Commercial and Institutional Swimming Pool Equipment and Suppliers," 1994, 60 pgs., Brock Enterprises, Hamden, CT.
RIGID–tex Metals—Imagination Rolled into Metal, Rigidized Metals Corporation, 1956, 32 pages.
RIGID–tex Metals Pattern Chart, Rigidized Metals Corporation, published on or before at least Feb. 26, 2001, 4 pages.

* cited by examiner

*Primary Examiner*—Jimmy G Foster

(57) ABSTRACT

A stainless steel aquatic component for use in an aquatic environment such as pools, spas, hot tubs, and shower rooms has a slip-resistant texture formed therein. The slip-resistant texture includes a plurality of protrusions which are punched into an outer surface of the aquatic component. A method of forming an aquatic component is also disclosed.

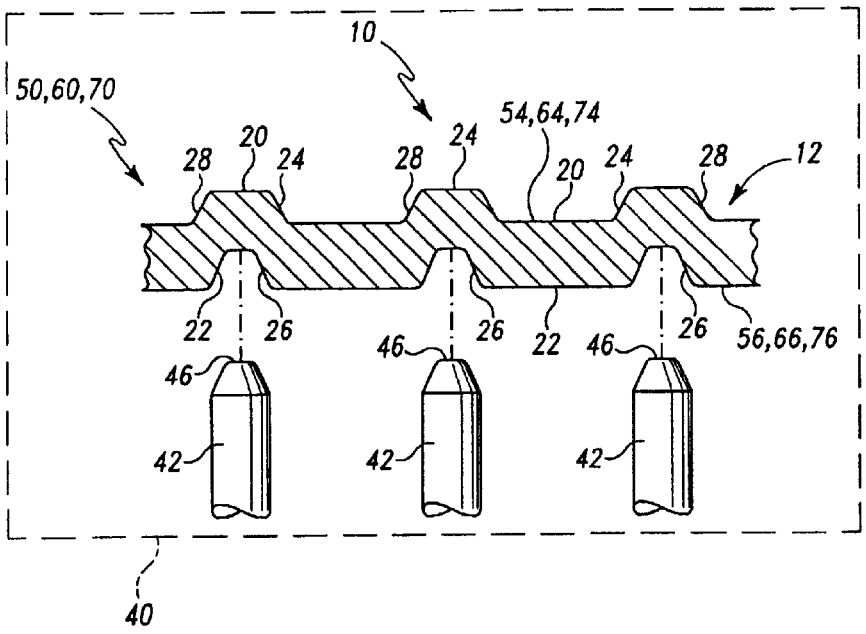

INTER PARTES REEXAMINATION CERTIFICATE ISSUED UNDER 35 U.S.C. 316

THE PATENT IS HEREBY AMENDED AS INDICATED BELOW.

AS A RESULT OF REEXAMINATION, IT HAS BEEN DETERMINED THAT:

Claims 1-23 are cancelled.

* * * * *